US007268478B2

(12) United States Patent
Jung et al.

(10) Patent No.: US 7,268,478 B2
(45) Date of Patent: Sep. 11, 2007

(54) ELECTRON GUN ASSEMBLY AND CATHODE RAY TUBE WITH THE SAME

(75) Inventors: Bong-Wook Jung, Suwon-si (KR); Deog-Ho Kim, Suwon-si (KR); Kwang-Jin Yun, Suwon-si (KR); Se-Ja-Chul Hwang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 233 days.

(21) Appl. No.: 11/209,701

(22) Filed: Aug. 24, 2005

(65) Prior Publication Data

US 2006/0043868 A1 Mar. 2, 2006

(30) Foreign Application Priority Data

Aug. 30, 2004 (KR) ..... 10-2004-0068750

(51) Int. Cl.
*H01J 29/46* (2006.01)

(52) U.S. Cl. ..... 313/447; 313/414

(58) Field of Classification Search ..... 313/414, 313/441, 446, 447, 458
See application file for complete search history.

(56) References Cited

U.S. PATENT DOCUMENTS

2002/0005690 A1* 1/2002 Choi ..... 313/414

* cited by examiner

*Primary Examiner*—Vip Patel
(74) *Attorney, Agent, or Firm*—Robert E. Bushnell, Esq.

(57) ABSTRACT

An electron gun assembly for a cathode ray tube where the distortion of the electron beam that ordinarily occurs at the periphery of the screen is reduced. The electron gun assembly includes a cathode for emitting electrons, and a plurality of grid electrodes having a control electrode facing the cathode. The grid electrodes sequentially follow the cathode to focus and accelerate the electrons emitted from the cathode. The control electrode has a beam passage hole with a horizontal length H, and a vertical length V being larger than the horizontal length H. The ratio of the vertical to horizontal lengths satisfies the following condition: $1.03 \leqq V/H \leqq 1.63$.

12 Claims, 9 Drawing Sheets

ELECTRON GUN ASSEMBLY AND CATHODE RAY TUBE WITH THE SAME

This application makes reference to, incorporates the same herein, and claims all benefits accruing under 35 U.S.C. §119 from an application for ELECTRON GUN ASSEMBLY AND CATHODE RAY TUBE WITH THE SAME earlier filed in the Korean Intellectual Property Office on 30 Aug. 2004 and there duly assigned Ser. No. 10-2004-0068750.

BACKGROUND OF THE INVENTION

1. Field of the Invention

The present invention relates to an electron gun assembly for a cathode ray tube, and in particular, to an electron gun assembly for a cathode ray tube that improves the structure of grid electrodes to reduce the distortion of the electron beam.

2. Description of Related Art

A projection television used for the wide-screen displaying generally has three projection cathode ray tubes for making monochrome display screens of red, green and blue, and an optical system for amplifying and projecting the monochrome images made by those cathode ray tubes to a projection screen and compounding them together as color images. The projection cathode ray tube includes a funnel with a neck, and a panel connected to the neck in a body with an inner phosphor screen. A single electron gun is mounted within the neck to emit a stream of electrons.

With the recent trends of wide-screen displays and high definition broadcasting, a higher resolution is needed for projection cathode ray tubes to improve upon the resolution over the entire screen area including the center of the screen as well as the periphery thereof. However, there is an aberration in the focusing causing a distortion of the electron beam at the periphery of the screen. This aberration is even more pronounced for large screens and for high definition viewing. Therefore, what is needed is an improved design for an electron gun assembly, and a design for a cathode ray tube using the improved electron gun assembly where the electron beam and thus the image at the edges of the screen are all in focus and undistorted.

SUMMARY OF THE INVENTION

It is therefore an object of the present invention to provide an improved design for an electron gun assembly.

It is also an object of the present invention to provide a design for a cathode ray tube that uses the improved electron gun assembly.

It is further an object of the present invention to provide a design for an electron gun assembly that compensates for the aberrations in focusing of an electron beam at a periphery of the display.

It is still an object of the present invention to provide a design for an electron gun assembly that will provide for improved image quality in a cathode ray tube, especially where the screen size is very large and where there is high definition.

It is yet another object of the present invention to provide a design for an electron gun assembly and a design for a cathode ray tube using the electron gun assembly that produces a well focused undistorted electron beam, even at the periphery of the display and even for large screen displays with high definition.

These and other objects may be achieved with an electron gun assembly that includes a cathode for emitting electrons, and a plurality of grid electrodes having a control electrode facing the cathode. The grid electrodes sequentially follow the cathode and serve to focus and accelerate the electrons emitted from the cathode. The control electrode is perforated by a beam passage hole with a horizontal length H, and a vertical length V being larger than the horizontal length H. The ratio of the vertical to horizontal lengths satisfies the following condition: $1.03 \leqq V/H \leqq 1.63$.

The beam passage hole of the control electrode may have the shape of an oval, a track, or a rectangle. The remaining grid electrodes are formed with a circular beam passage hole or a columnar body internally allowing the passage of the electron beam. The cathode is a single cathode for emitting a stream of electrons.

The grid electrodes include the control electrode, an accelerating electrode, a first anode electrode, a focusing electrode and a second anode electrode. The first and the second anode electrodes are electrically connected to each other. The second anode electrode partially surrounds the focusing electrode. The focusing electrode has a diameter-enlarged portion located within the second anode electrode.

According to another aspect of the present invention, the cathode ray tube includes an electron gun assembly, a neck internally mounted with the electron gun assembly, a funnel and a panel placed facing the neck. A deflection yoke is mounted around the outer circumference of the funnel to form a magnetic field for deflecting the electron beam. A phosphor screen is formed on the inner surface of the panel. The control electrode has a beam passage hole with a horizontal length H, and a vertical length V being larger than the horizontal length H. The ratio of the vertical to horizontal lengths satisfies the following condition: $1.03 \leqq V/H \leqq 1.63$. The electron gun has a single cathode, and the phosphor screen is formed with any one color of red, green and blue. The inner surface of the panel is formed with a convex surface facing the neck.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

A projection television used for the wide-screen displaying generally has three projection cathode ray tubes for producing monochrome display screens of red, green and blue, and an optical system for amplifying and projecting the monochrome images made at those cathode ray tubes to a projection screen and compounding them as color images. The projection cathode ray tube includes a funnel with a neck, and a panel connected to the neck in a body with an inner phosphor screen. A single electron gun is mounted within the neck to emit a stream of electrons.

With the recent trends of wide-screen displays and high definition broadcasting, the need to have a focused and undistorted electron beam is even more important than ever before. The electron beam and the image displayed needs to be of good quality at all portions on the screen, including the periphery of the screen.

The projection cathode ray tube has an inverse-spherical structure where the panel has an inner convex surface that faces the neck to achieve high brightness. However, it is rather difficult to focus an electron beam at the periphery of the screen, compared to a color cathode ray tube using a shadow mask. Also, the electron beam emitted from the electron gun is deflected by the magnetic field generated from the deflection yoke to thus form a raster, and in this process, the electron beam is distorted at the periphery of the screen due to the distortion caused by the deflection by the magnetic field of the deflection yoke.

Figure 1:
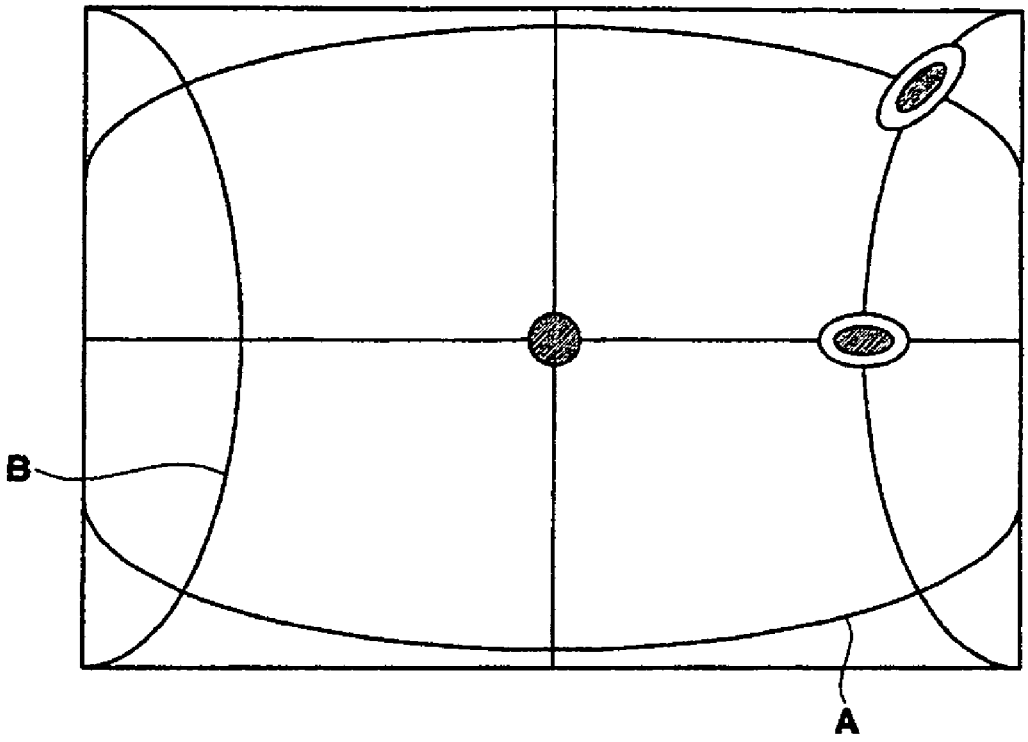
FIG. 1 schematically illustrates the deflection magnetic field and the shape of an electron beam in a cathode ray tube.

In order to direct the electron beam toward the phosphor screen from the electron gun, an electron lens with a quadrupole component as illustrated in FIG. 1 is formed on the route of the electron beam around the deflection yoke. With this electron lens, the magnetic field for displacing the electron beam in the vertical direction (the horizontal deflection magnetic field (A) is formed to have a convex shape, and the magnetic field for displacing the electron beam in the horizontal direction (the vertical deflection magnetic field (B) is formed to have a concave shape. Accordingly, with the focus voltage of the electron beam scanned toward the periphery of the screen, the vertical focus voltage component is greater than the horizontal focus voltage component so that the horizontal diameter of the electron beam becomes enlarged.

Figure 2:
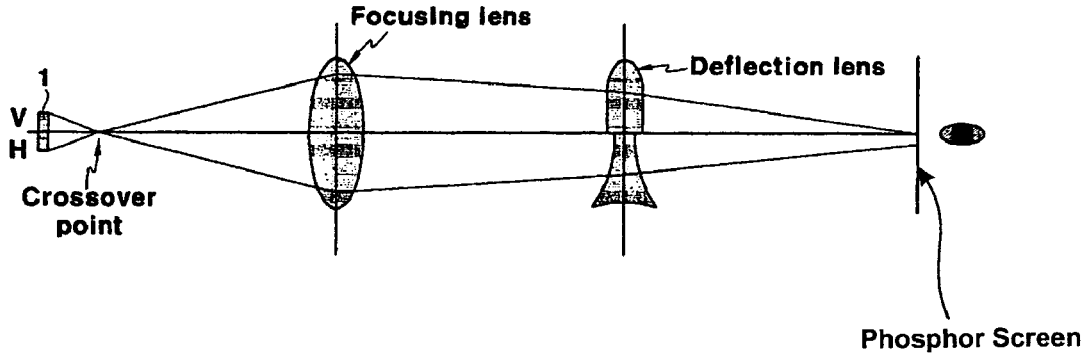
FIG. 2 schematically illustrates the route of the electron beam and the shape thereof at the periphery of the screen of a cathode ray tube.

Turning now to FIG. 2, FIG. 2 schematically illustrates the route of the horizontal component H and the vertical component V of the electron beam projected toward the periphery of a phosphor screen and the shape of the electron beam that lands on the phosphor screen using the yoke deflection magnetic field of FIG. 1. A common electron gun assembly includes a cathode, and a control electrode, an accelerating electrode, a focusing electrode and an anode electrode sequentially following the cathode by a predetermined distance. The electrons emitted from the cathode 1 pass through the control electrode and are crossed over and pre-focused. The pre-focused electrons pass the focusing lens of the focusing electrode while being focused, and proceed toward the phosphor screen while being deflected by the deflection magnetic field, thus landing on the target portions of the phosphor screen. In this process, the deflection yoke serves as a convex electron lens with respect to the vertical component V of the electron beam, and serves as a concave electron lens with respect to the horizontal component H of the electron beam.

Consequently, with the projection cathode ray tube, when the focusing is made with respect to the vertical component of the electron beam scanned toward the periphery of the screen, the horizontal component is under-focused while enlarging the horizontal diameter of the electron beam. By contrast, when the focusing is made with respect to the horizontal component of the electron beam, the vertical component is over-focused, thus making a halo.

Figure 3:
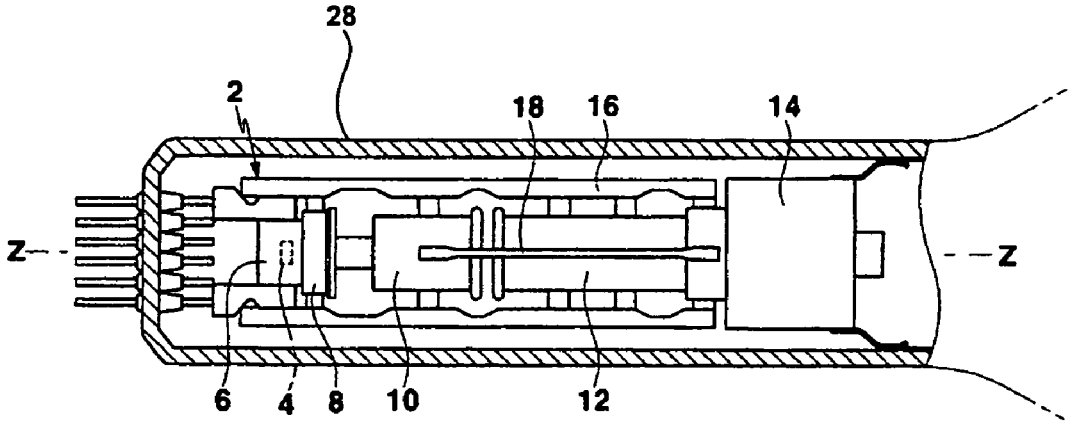
FIG. 3 is a partial sectional view of a neck mounted with an electron gun assembly according to an embodiment of the present invention.
Figure 4:
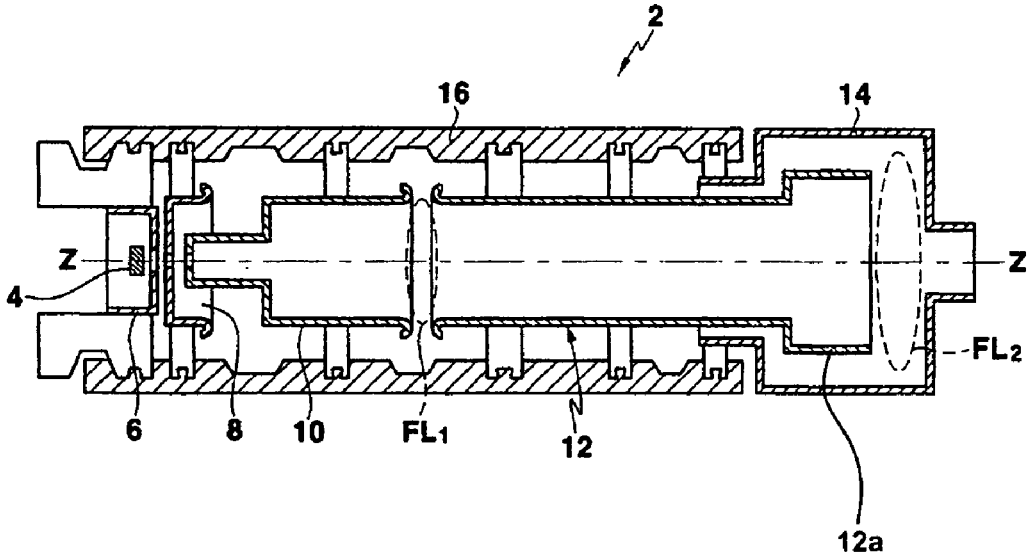
FIG. 4 is a cross sectional view of the electron gun assembly according to the embodiment of the present invention.

Turning now to FIGS. 3 and 4, FIG. 3 is a partial sectional view of a neck 28 internally mounted with an electron gun assembly 2 according to an embodiment of the present invention, and FIG. 4 is a cross sectional view of the electron gun assembly 2 of FIG. 3. As illustrated in FIGS. 3 and 4, the electron gun assembly 2 includes a cathode 4, grid electrodes 6, 8, 10, 12 and 14 for focusing and accelerating the electrons emitted from the cathode 4 while forming an electron beam, and a support 16 for serially arranging and supporting the grid electrodes 6, 8, 10, 12 and 14.

In this embodiment, the grid electrodes 6, 8, 10, 12 and 14 include a control electrode 6, an accelerating electrode 8, a first anode electrode 10, a focusing electrode 12, and a second anode electrode 14 sequentially following the cathode 4 (i.e., progressively in the+z direction) while being spaced apart from each other by a distance. The first and the second anode electrodes 10 and 14 are electrically connected to each other via a connector 18.

The control electrode 6 and the accelerating electrode 8 form a triode structure together with the cathode 4 to control the electron emission of the cathode 4 while pre-focusing the electrons emitted from the cathode 4. For this purpose, the voltage applied to the control electrode 6 is established to be lower than the voltage applied to the cathode 4, and the voltage applied to the accelerating electrode 8 is to be higher than the voltage applied to the cathode 4.

Figure 5:
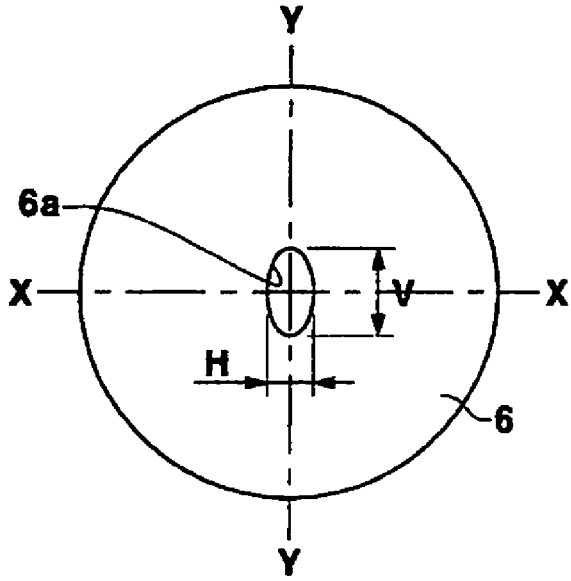
FIG. 5 is a right side view of a control electrode of the electron gun assembly illustrated in FIG. 3.

The control electrode 6 is perforated by a beam passage hole 6*a*, this beam passage hole 6*a* being positioned so that the electron beam from the cathode 4 can pass therethrough. FIG. 5 illustrates one embodiment of where the beam passage hole 6*a* is oval in shape and extends a greater distance V in the vertical y-direction than H in the horizontal x-direction. As to be discussed later in FIGS. 10 and 11, the ratio of V/H for beam passage hole 6*a* must be between 1.03-1.63. The horizontal direction indicates the direction corresponding to left to right on the screen X-X (or x-axis), and the vertical direction indicates the direction corresponding to up and down on the screen Y-Y (or y-axis).

Figure 6:
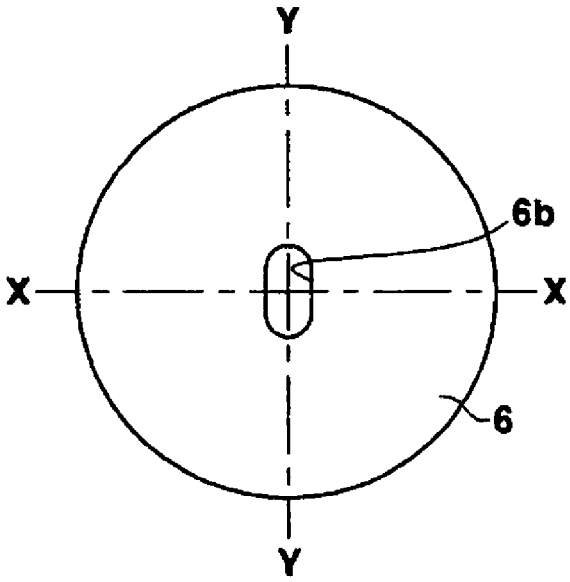
FIGS. 6 and 7 are right side views of variants of the control electrode of the electron gun assembly illustrated in FIG. 3.
Figure 7:
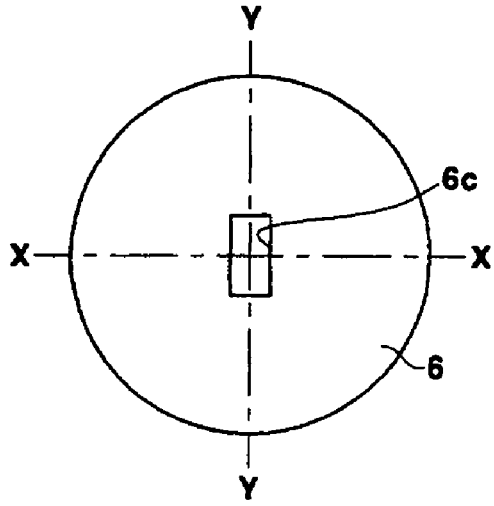

As illustrated in FIG. 5, the beam passage hole 6*a* of the control electrode 6 is formed in the shape of an oval. Alternatively, as illustrated in FIGS. 6 and 7, the beam passage hole 6*b* or 6*c* can be formed with a shape of a track or a rectangle, respectively, or other shapes satisfying the previously-described V/H ratio range.

Meanwhile, the grid electrodes 8, 10, 12 and 14, with the exception of the control electrode 6, can be designed to be perforated by a circular beam passage hole placed on the route of the electron beam emanating from the cathode 4, or be formed with a columnar body internally allowing the passage of the electron beam. The electron gun assembly 2 can be a single electron gun mounted with a single cathode 4 emitting the stream of electrons.

High voltages of 30 kV or more are applied to the first and the second anode electrodes 10 and 14, and variable focus voltages of 10-20 kV are applied to the focusing electrode 12. A first focusing lens $FL_1$ is located between the first anode electrode 10 and the focusing electrode 12 due to the potential difference between the focusing electrode 12 and the two anode electrodes 10 and 14. A second focusing lens $FL_2$ is located between the focusing electrode 12 and the second anode electrode 14. The electrons are pre-focused while passing the control electrode 6, and finally focused and accelerated while passing the two focusing lens $FL_1$ and $FL_2$, followed by progressing toward the phosphor screen (not illustrated).

In order to enlarge the diameter of the second focusing lens $FL_2$, the focusing electrode 12 is partially placed within the second anode electrode 14 while forming a large-diameter portion 12*a* therein. Of course, the focusing electrode 12 and the second anode electrode 14 are spaced apart from each other by a sufficient distance, thus achieving excellent withstand voltage characteristic between them in a stable manner.

Figure 8:
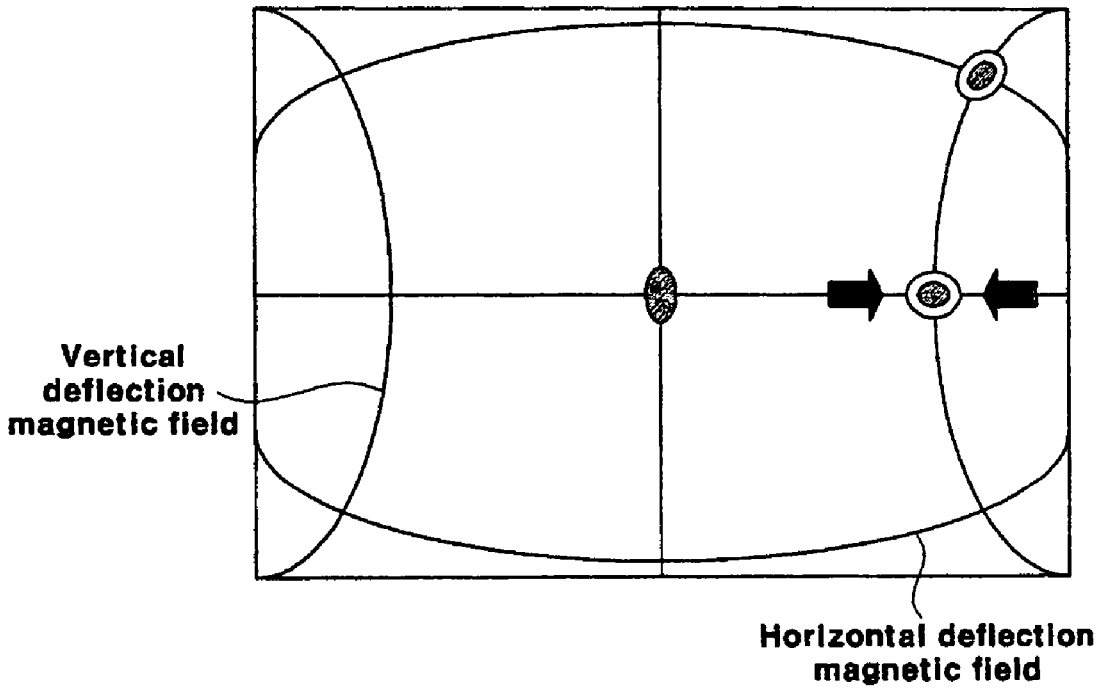
FIG. 8 schematically illustrates the deflection magnetic field and the shape of the electron beam in a cathode ray tube according to an embodiment of the present invention.

With the above-structured electron gun assembly 2 as illustrated in FIG. 8 and compared with FIG. 1, the formation of the vertically elongated beam passage hole 6*a* in the control electrode 6 is to compensate for the distortion of an electron beam due caused by the yoke. In other words, the novel designs for the beam passage hole in the control electrode compensates for the distortion that occurs when the vertically elongated electron beam is formed at the center of the screen and deflected toward the periphery of the screen due to the deflection magnetic field. This is possible because the electron beam from the electron gun assembly 2 is adapted to the shape of the beam passage hole 6*a* of the control electrode 6, and lands on the phosphor screen. The result of the beam passage hole 6*a* is a less distorted electron beam at the edges of the display, as it illustrated in FIG. versus FIG. 1.

Figure 9:
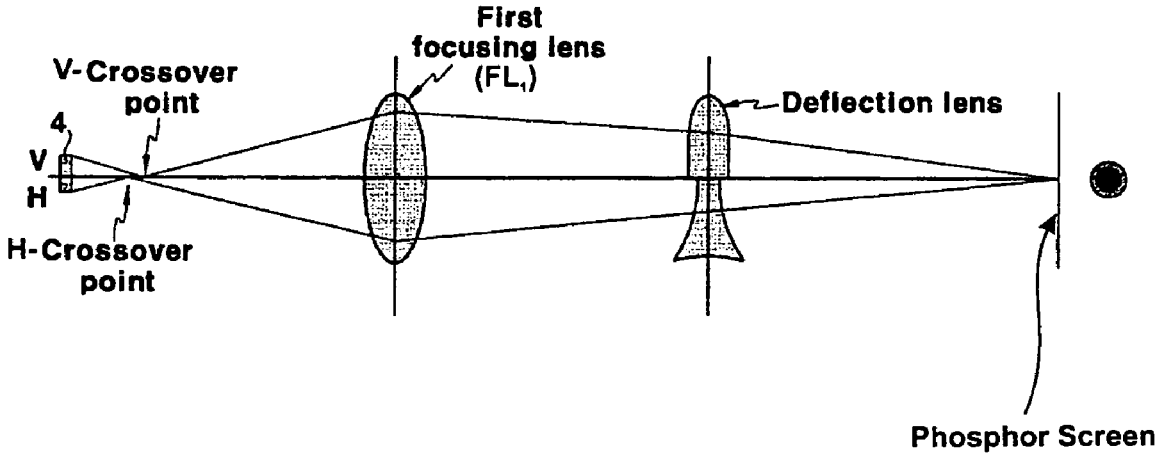
FIG. 9 schematically illustrates the route of an electron beam and the shape thereof at the periphery of the screen in a cathode ray tube according to an embodiment of the present invention.

Turning now to FIGS. 2 and 9, FIG. 9 schematically illustrates the route of an electron beam and the shape thereof at the periphery of the screen in a cathode ray tube according to an embodiment of the present invention and FIG. 2 comparatively illustrates the route without the designed beam passage hole. When the beam passage hole 6*a* of the control electrode 6 is vertically elongated as illustrated in FIG. 9, the cross-over point of the horizontal component H of the electron beam is displaced toward the cathode 4 so that the horizontal diameter of the electron beam incident upon the first focusing lens $FL_1$ is reduced. This results in a reduction of the horizontal diameter of the electron beam landing on the phosphor screen. Accordingly, with the electron gun assembly 2 according to the present embodiment, the horizontal diameter of the electron beam at the periphery of the screen is reduced, thus compensating for the distortion of the electron beam. Furthermore, with the electron gun assembly 2 according to the present embodiment, the life span characteristics of the cathode 4 and the focusing characteristic of the electron beam can be well obtained, compared to the electron gun assembly where a circular beam passage hole is formed at the control electrode.

The life span of the cathode is closely related to the radius of the loading region where the electron beam is emitted with the driving of the electron gun (referred to hereinafter as the "loading radius"), and the loading radius is determined depending on the size of the beam passage hole of the control electrode. In consideration of the life span characteristics of the cathode, it is advantageous to enlarge the beam passage hole of the control electrode, but in consideration of the focusing characteristic, it is advantageous to reduce the size of the beam passage hole of the control electrode as much as possible.

In this embodiment, as the control electrode 6 has a vertically elongated beam passage hole 6*a*, the loading radius of the cathode 4 is kept to be the same as when a circular beam passage hole is formed in the control electrode, but the horizontal diameter of the electron beam is enhanced. In the case when beam passage hole 6*a* of the control electrode 6 has a horizontal size of 0.52 mm and a vertical size of 0.58 mm, the loading radius of the cathode 4 is the same as when a circular beam passage hole with a diameter of 0.55 mm is formed in the control electrode.

Accordingly, with the electron gun assembly 2 according to the present embodiment, the life span characteristic thereof is the same as when a circular beam passage hole with a diameter of 0.55 mm is formed in the control electrode, and the focusing characteristic thereof at the periphery of the screen is similar to when a circular beam passage hole with a diameter of 0.52 mm is formed in the control electrode. The fact that a hole in the control electrode where H=0.52 mm and V=0.58 mm produces a beam having a focusing characteristic similar to a circular hole with a 0.52 mm diameter will be further explained in conjunction with FIGS. 10 and 11.

Figure 10:
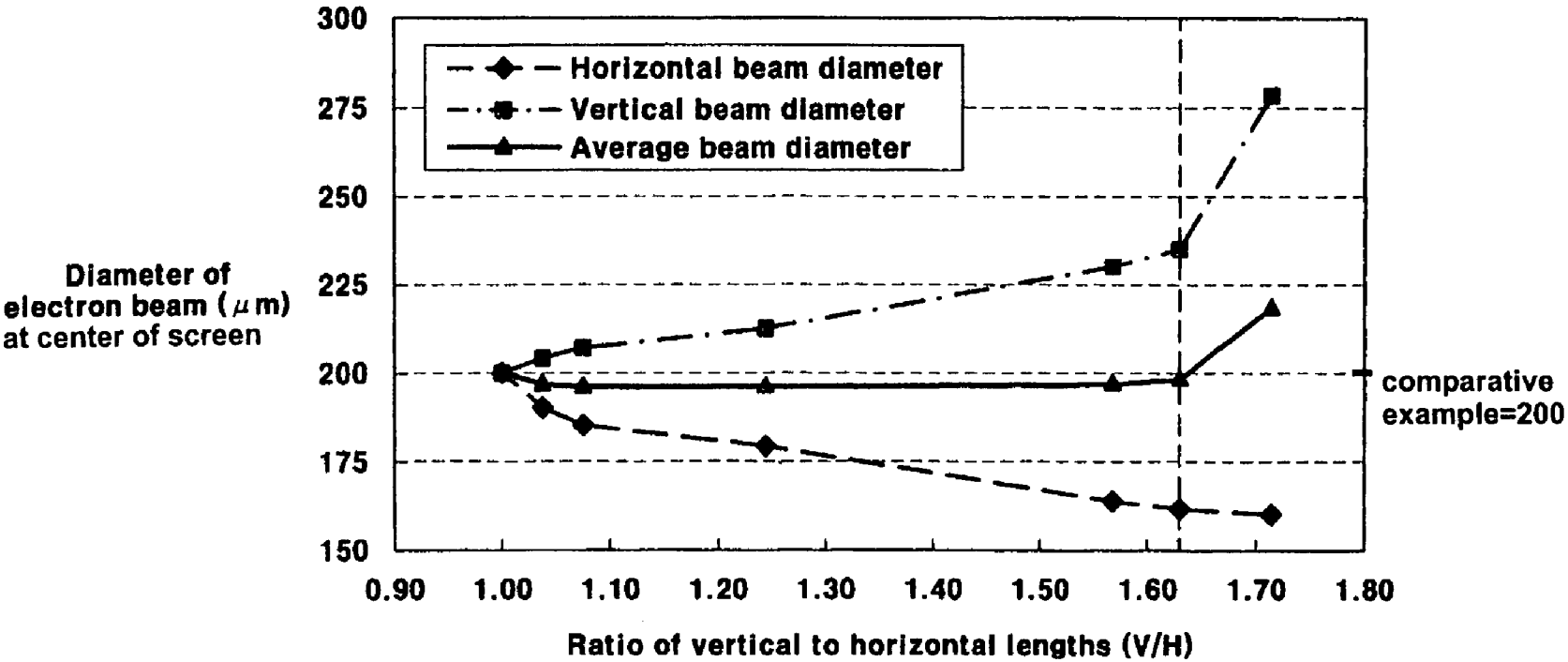
FIG. 10 is a graph illustrating the variation in the diameter of the electron beam at the center of the screen as a function of the ratio of the vertical to horizontal lengths V/H of a beam passage hole formed in the control electrode.
Figure 11:
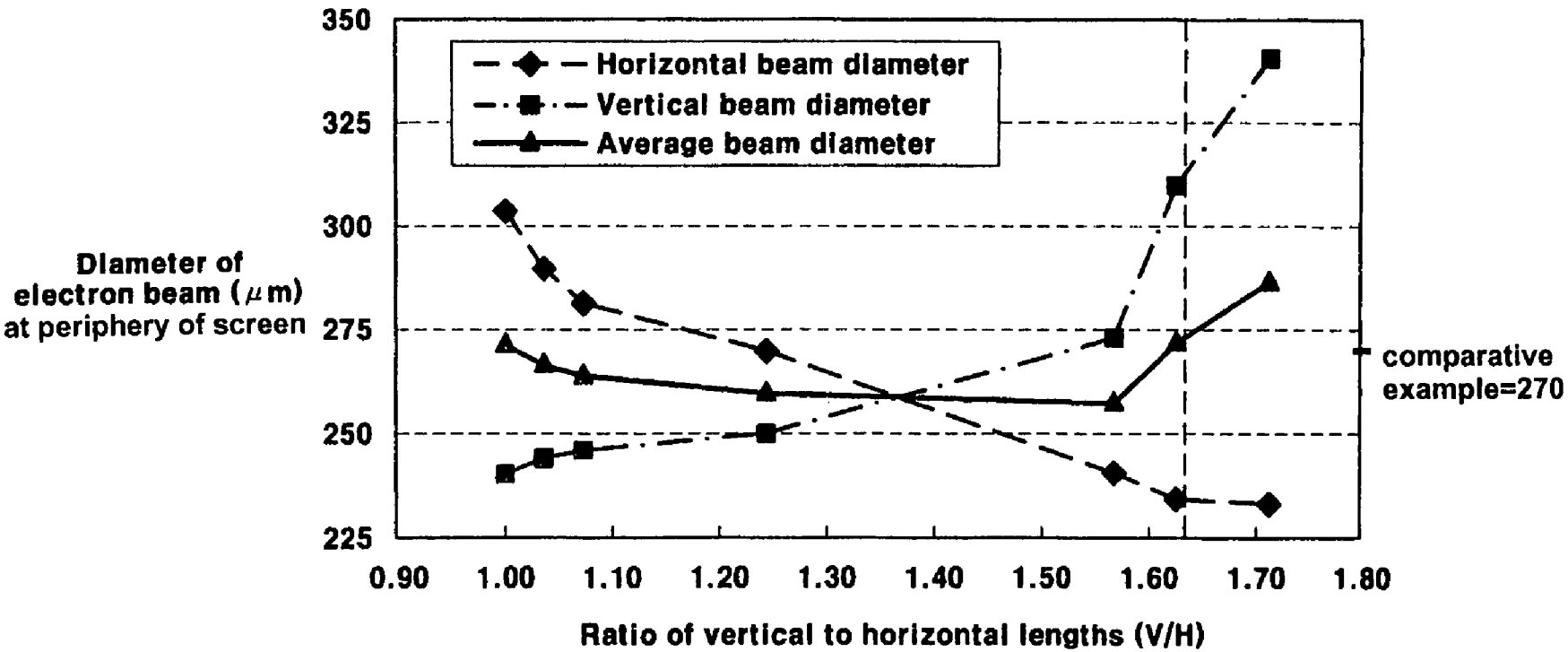
FIG. 11 is a graph illustrating the variation in the diameter of the electron beam at the periphery of the screen as a function of the ratio of the vertical to horizontal lengths V/H of the beam passage hole formed in the control electrode.

Turning now to FIGS. 10 and 11, FIG. 10 is a graph illustrating the variation in the diameter of the electron beam at the center of the screen as a function of the ratio of the vertical to horizontal lengths V/H of the beam passage hole perforating the control electrode, and FIG. 11 is a graph illustrating the variation in the diameter of the electron beam at the periphery of the screen as a function of the ratio of the vertical to horizontal lengths V/H of the beam passage hole perforating the control electrode.

As illustrated in FIG. 10, the diameter of the electron beam measured in relation to Comparative Example where the V/H ratio is 1.00 is about 200 μm. As the V/H ratio is greater than 1.00, the horizontal diameter of the electron beam is reduced to less than 200 μm and the vertical diameter of the electron beam is increased to more than 200 μm. When the V/H ratio of the beam passage hole is in the range of 1.00-1.63, the average diameter of the electron beam measured at the center of the screen is 198 μm or less, which is lower than that of the Comparative example.

As illustrated in FIG. 11, the diameter of the electron beam measured in relation to the Comparative Example at a periphery of the screen where the V/H ratio is 1.00 is about 270 μm. As the V/H ratio increases to over 1.00, the horizontal diameter of the electron beam gradually decreases from about 305 μm, and the vertical diameter of the electron beam becomes gradually increases from about 235 μm. When the V/H ratio of the beam passage hole is in the range of 1.00-1.63, the average diameter of the electron beam measured at the periphery of the screen is 267 μm or less, being lower than that of the Comparative example. Accordingly, in case an optimum V/H ratio is maintained, the average diameter of the electron beam is reduced to as small as 256 μm at a periphery of the screen.

When the V/H ratio exceeds 1.63 in relation to both of FIGS. 10 and 11, the vertical diameter of the electron beam drastically increases, thus further distorting the electron beam. In consideration of the enhancement of the beam diameter at the center of the screen as well as at the periphery thereof, the highest value of the V/H ratio is preferably established to be 1.63.

Assume thin the control electrode 6 is punched to form a vertically elongated beam passage hole 6*a*. In consideration of the work dispersion of about 0.05 mm, the horizontal length H and the vertical length V of the beam passage hole 6*a* should be differentiated by about 0.2 mm or more to qualify it as a vertically elongated hole. Accordingly, the minimal value of the V/H ratio is preferably established to be 1.03 or more.

Figure 12:
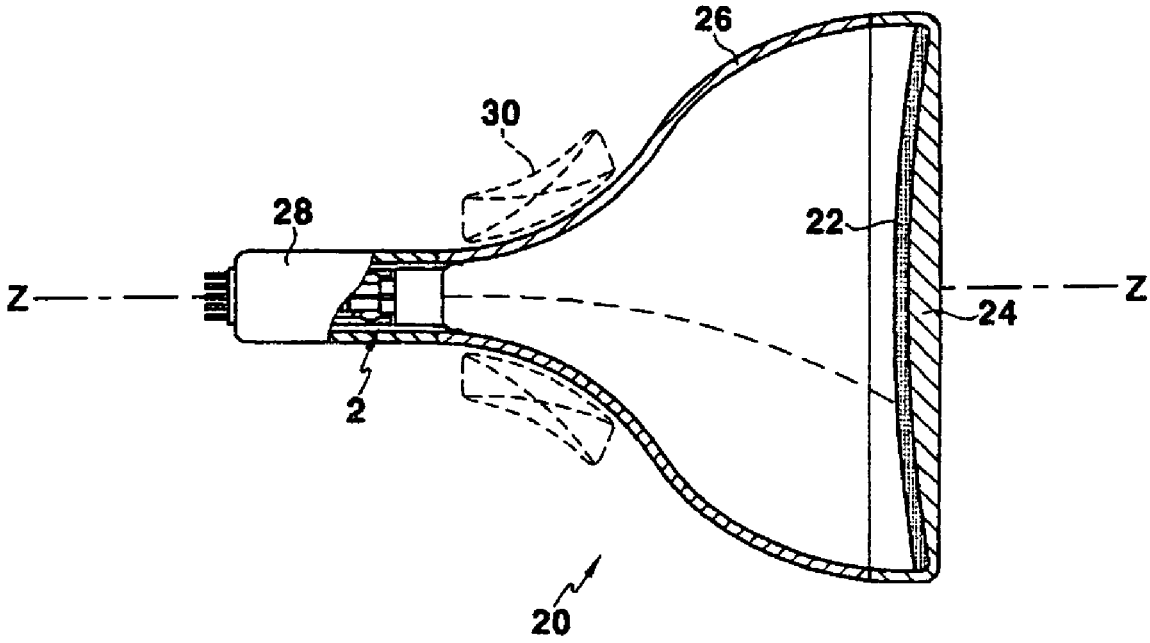
FIG. 12 is a partial sectional view of a cathode ray tube according to an embodiment of the present invention.

Turning now to FIG. 12, FIG. 12 is a cross sectional view of a cathode ray tube 20 mounted with an electron gun assembly 2, illustrating a projection cathode ray tube realizing a monochrome image by emitting a stream of electrons from the electron gun assembly 2. As illustrated in FIG. 12, the cathode ray tube 20 includes a panel 24 with an inner phosphor screen 22, and a funnel 26 and a neck 28 placed rear (to the left or -z direction of) the panel 24. An electron gun assembly 2 with the above-described structure is mounted within the neck 28 to emit an electron beam toward the phosphor screen 22. A deflection yoke 30 is mounted around the outer circumference of the funnel 26, and generates a deflection magnetic field to deflect the electron beam emitted from the electron gun assembly 2, thus scanning the electron beam onto the phosphor screen 22.

The phosphor screen 22 is colored with any one of red, green and blue. The panel 24 with the phosphor screen 22 has an inner convex surface facing the neck 28, that is, an inverse-spherical surface.

The deflection yoke 30 forms an electron lens with a quadrupole component as illustrated in FIG. 9. That is, the electron lens takes a convex outline for the vertical component of the electron beam, and a concave outline for the horizontal component thereof. With the distortion of the electron beam deflected at the periphery of the screen, the horizontal diameter of the electron beam at the periphery of the screen is reduced with the improved structure of the control electrode 6, thus minimizing the distortion of the electron beam.

The projection display device (not illustrated) has three projection cathode ray tubes for realizing monochrome display screens of red, green and blue, and an optical system (not illustrated) for amplifying and projecting the monochrome images made at the cathode ray tubes to a projection screen (not illustrated), thus displaying a predetermined color image.

As described above, with the inventive electron gun assembly, as a beam passage hole with the previously-described shape is formed in the control electrode, the hole compensates for the increased beam diameter of the electron beam deflected toward the periphery of the screen, thus minimizing the distortion of the electron beam. Accordingly, with the inventive cathode ray tube, the electron beam distortion is reduced without significantly altering the grid electrode structure, thus enhancing the display screen quality.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron gun assembly, comprising:

a cathode adapted to emit electrons; and a plurality of grid electrodes that includes a control electrode that is arranged to face the cathode, the grid electrodes sequentially following the cathode and being adapted to focus and accelerate the electrons emitted from the cathode, the control electrode being perforated by a beam passage hole having a horizontal length H and a vertical length V, the ratio of V/H satisfying the inequality $1.03 \leqq V/H \leqq 1.63$.

2. The electron gun assembly of claim 1, the beam passage hole being of a shape selected from the group consisting of an oval, a track and a rectangle.

3. The electron gun assembly of claim 1, each of the grid electrodes, except for the control electrode, being either perforated a circular beam passage hole or having a columnar body adapted to internally allow a passage of the electron beam.

4. The electron gun assembly of claim 1, the cathode being an only cathode for emitting a stream of electrons in the electron gun assembly.

5. The electron gun assembly of claim 1, the plurality of grid electrodes comprises:

the control electrode;

an accelerating electrode;

a first anode electrode;

a focusing electrode; and a second anode electrode, the first anode electrode and the second anode electrode being electrically connected to each other.

6. The electron gun assembly of claim 5, the second anode electrode partially surrounding the focusing electrode, the focusing electrode comprising a diameter-enlarged portion arranged within the second anode electrode.

7. A cathode ray tube, comprising:

an electron gun assembly that includes a cathode, a plurality of grid electrodes that includes a control electrode arranged to face the cathode, the grid electrodes sequentially following the cathode and being adapted to focus and accelerate an electron beam emanating from the cathode, and a support adapted to serially arrange and support the grid electrodes;

a neck internally mounted with the electron gun assembly;

a funnel and a panel arranged to a front of the neck;

a deflection yoke arranged around an outer circumference of the funnel and adapted to produce a magnetic field that deflects the electron beam; and a phosphor screen arranged on the inner surface of the panel, the control electrode being perforated by a beam passage hole arranged with a horizontal length H and a vertical length V, a ratio of V/H satisfying the inequality $1.03 \leqq V/H \leqq 1.63$.

8. The cathode ray tube of claim 7, the electron gun including only one cathode, the phosphor screen being a color selected from the group consisting of red, green and blue.

9. The cathode ray tube of claim 7, an inner surface of the panel comprising a convex surface arranged to face the neck.

10. The cathode ray tube of claim 7, the beam passage hole of the control electrode being of a shape selected from the group consisting of an oval, a track and a rectangle.

11. The cathode ray tube of claim 7, the grid electrodes comprises:

the control electrode;

an accelerating electrode;

a first anode electrode;

a focusing electrode; and a second anode electrode, the first anode electrode and the second anode electrode being electrically connected to each other.

12. The cathode ray tube of claim 11, the second anode electrode partially surrounding the focusing electrode, the focusing electrode comprising a diameter-enlarged portion arranged within the second anode electrode.

* * * * *